US007903989B2

(12) United States Patent
Tanaka

(10) Patent No.: US 7,903,989 B2
(45) Date of Patent: Mar. 8, 2011

(54) DEVELOPING APPARATUS WITH DEFORMATION DETECTION AND VOLTAGE CORRECTION

(75) Inventor: Takayuki Tanaka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 12/414,002

(22) Filed: Mar. 30, 2009

(65) Prior Publication Data

US 2009/0252514 A1 Oct. 8, 2009

(30) Foreign Application Priority Data

Apr. 7, 2008 (JP) ..... 2008-099556

(51) Int. Cl.
*G03G 15/08* (2006.01)

(52) U.S. Cl. ..... 399/55; 399/284

(58) Field of Classification Search ..... 399/55, 399/53, 284, 274
See application file for complete search history.

(56) References Cited

U.S. PATENT DOCUMENTS

| | | | | |
|---|---|---|---|---|
| 7,734,205 | B2 * | 6/2010 | Sakaizawa et al. | 399/55 |
| 2009/0169229 | A1 * | 7/2009 | Mutoh | 399/55 |

FOREIGN PATENT DOCUMENTS

| | | | |
|---|---|---|---|
| JP | 2003-066716 A | * | 3/2003 |
| JP | 2006-154369 A | | 6/2006 |
| JP | 2002-333772 A | | 11/2006 |
| JP | 2007-240595 A | | 9/2007 |
| JP | 2007-264372 A | * | 10/2007 |

* cited by examiner

*Primary Examiner* — Sophia S Chen

(74) *Attorney, Agent, or Firm* — Fitzpatrick, Cella, Harper & Scinto

(57) ABSTRACT

A developing apparatus includes a developer carrying member rotatably provided for carrying a developer; a regulating member that has conductivity, and is provided to be capable of being in contact with the developer carrying member for regulating a amount of the developer carried by the developer carrying member; a power supply that applies voltage to the regulating member; a deformation detecting unit that detects information relating to the deformation of the developer carrying member; and a control unit that controls the power supply to apply a correction voltage when a deformed portion of the developer carrying member passes through the regulating member in order that the amount of the developer carried by the developer carrying member in the circumferential direction is in uniform based on a result of the detection by the deformation detecting unit.

8 Claims, 19 Drawing Sheets

DEVELOPING APPARATUS WITH DEFORMATION DETECTION AND VOLTAGE CORRECTION

BACKGROUND OF THE INVENTION

1. Field of the Invention

The present invention relates to a developing apparatus used for an image forming apparatus, such as a copier or a printer, having a function of forming an image onto a recording material, such as a sheet.

2. Description of the Related Art

An image forming process of an image forming apparatus of a dry one-component electrophotographic system employing a contact developing system will be described with reference to FIG. 19.

Toner (developer) 101 in a developing container 107 of a developing apparatus 102 is carried to a toner carrying member 106, serving as a developer carrying member, by a stirring member 103 and a supplying roller 104. The toner 101 is brought into sliding contact with the contact portion between the toner carrying member 106 and the supplying roller 104 so as to be deposited onto the toner carrying member 106. The deposited toner passes through the contact portion between a regulating member 105 and the toner carrying member 106. In this case, the deposited toner is brought into sliding contact with the contact portion between the regulating member 105 and the toner carrying member 106 so as to be charged and to form a thin layer. Then, the deposited toner passes through the contact portion between the toner carrying member 106 and an image bearing member 113 with the rotation of the toner carrying member 106.

The image bearing member 113 is charged to a polarity which is the same as the polarity of the toner 101 (charging) by a charging roller 114 before the image bearing member 113 reaches the contact portion between the toner carrying member 106 and the image bearing member 113, and exposed by a laser scanner 115 (exposure). Laser 116 in the laser scanner 115 scans the surface of the image bearing member 113 by the rotation of a polygon mirror 117, while controlling light quantity based on the image data. The image bearing member 113 has photoconductivity, so that the potential at the exposed portion is reduced according to the exposure amount. As a result, an electrostatic latent image is formed on the image bearing member 113 due to the potential difference between the exposed portion and non-exposed portion.

The toner carrying member 106 has a polarity which is the same as that of the toner 101, and has applied thereto a voltage having a potential smaller than a potential at the non-exposed portion of the image bearing member 113 and greater than a potential at the maximum exposed portion. When the toner 101 on the toner carrying member 106 is brought into contact with the image bearing member 113, the exposed portion receives force in the direction toward the image bearing member 113 from the toner carrying member 106 by electrostatic force, while the non-exposed portion receives force in the reverse direction. Therefore, when the toner passes through the contact portion, the toner 101 at the exposed portion is deposited onto the image bearing member 113, and the electrostatic latent image is developed as a toner image (developing).

Thereafter, voltage having a polarity reverse to that of the toner 101 is applied to a transfer roller 119 with a recording material nipped between the transfer roller 119 and the image bearing member 113, whereby the toner image on the image bearing member 113 receives electrostatic force directing toward the recording material so as to be transferred onto the recording material (transfer). The recording material having the toner image transferred thereon passes between heated pressure members 121 in a fixing unit 120, thereby being fixed onto the recording material because the toner is melted (fixing). The remaining toner 101 on the image bearing member 113 that is not transferred is removed from the image bearing member 113 by a cleaning member 122, which is in contact with the image bearing member 113, and put into a waste toner container 123 (cleaning).

However, in the image forming apparatus of a dry one-component electrophotographic system, the contact developing system might entail a problem described below when the electrostatic latent image on the image bearing member is developed.

Since the toner carrying member 106 and the image bearing member 113 are brought into contact with each other for developing in the contact developing system, at least one of the toner carrying member 106 and the image bearing member 113 is made of a viscoelastic material in most cases. In many image forming apparatuses, the toner carrying member is made into a viscoelastic material made of a silicon rubber.

The toner carrying member 106 is elastically deformed due to the pressure applied at the contact portion between the toner carrying member 106 and the regulating member 105. When the image forming apparatus is stopped for a long period of time, the regulating member 105 continues to apply pressure to the toner carrying member 106 for a long period of time. In such a case, the portion of the toner carrying member 106 where the regulating member 105 is brought into contact might have permanent deformation, which is not returned to the state before the application of the pressure, due to the compression, even when the toner carrying member is released from the regulating member 105, even when the application of pressure is discontinued, or even when the regulating member 105 is separated.

The permanent deformation due to the compression of the toner carrying member 106 might be generated at the contact portion between the toner carrying member 106 and the image bearing member 113. At this deformed portion, the contact state between the toner carrying member 106 and the regulating member 105 is changed when the deformed portion passes through the contact portion between the toner carrying member 106 and the regulating member 105 through the drive of the toner carrying member 106, so that the amount of the toner per unit area on the toner carrying member might be changed.

In the contact developing system, the amount of toner to be developed is determined by an electric field in the toner layer. Therefore, when the amount of toner on the toner carrying member is changed, the amount of toner to be developed to the same electrostatic latent image is changed. Accordingly, the uniformity of an image density is lowered before or after the deformed portion.

The methods described below have been proposed in order to solve this problem.

(1) Method of reducing a contact force of a regulating member when an image is not formed (Japanese Patent Application Laid-Open No. 2002-333772)

In this method, a driving mechanism is mounted to the regulating member for reducing the contact pressure of the regulating member when the image is not formed. By virtue of this configuration, the deformation of the toner carrying member is reduced, so that the non-uniformity in the image density can be prevented.

(2) Method of applying vibrating electric field to a regulating member (Japanese Patent Application Laid-Open No. 2007-240595)

In this method, storage means provided to the developing apparatus calculates the period when the image forming apparatus is stopped. When the period, when the image forming apparatus is stopped, reaches the period by which the permanent deformation due to the compression is caused, the vibrating electric field is applied to the regulating member. By virtue of this configuration, the toner on the toner carrying member is rearranged through the application of the vibrating electric field to the regulating member, when the toner carrying member passes the regulating member. Thus, the change in the toner amount at the deformed portion on the toner carrying member is reduced, whereby the non-uniformity in the image density can be prevented.

(3) Method of controlling electric current, flowing through a regulating member, to be a constant current (Japanese Patent Application Laid-Open No. 2006-154369)

In this method, voltage is applied to the regulating member having conductivity so as to control electric current, flowing through the regulating member, to be constant. By virtue of this configuration, the current flowing through the regulating member, which depends upon the toner amount on the toner carrying member, is controlled to be constant, whereby the change in the amount of the toner on the toner carrying member is reduced. Thus, the non-uniformity in the image density can be prevented.

However, in the above-mentioned related arts, the problems described below might be generated.

Specifically, in the method, described in (1), of reducing the contact pressure of the regulating member when an image is not formed, the size of the developing apparatus might be increased due to the addition of the driving mechanism for the regulating member.

In the method, described in (2), of applying the vibrating electric field to the regulating member, the regulating member might be vibrated to generate noise, since the vibrating electric field having audible frequency is applied to the regulating member. Further, the toner might fly at the outlet side of the contact portion between the toner carrying member and the regulating member. In this case, the toner unfavorably scatters.

At the deformed portion of the toner carrying member, the regulating member moves with the deformation of the toner carrying member, when it passes the contact portion. Therefore, the electrostatic capacitances of the regulating member and the toner carrying member change, so that induced current also flows through the regulating member. Accordingly, there is concern that there is no correlation between the current flowing through the regulating member and the amount of toner.

In the method, described in (3), of controlling the current flowing through the regulating member to be constant, the current including the induced current caused by the motion of the regulating member is controlled to be constant. Therefore, the change in the toner amount might not be able to be reduced at the deformed portion of the toner carrying member.

As described above, the developing apparatus and the image forming apparatus in the related arts cannot reduce the change in the image density at the deformed portion of the toner carrying member without causing adverse effects, such as the increase in size of the apparatus, noise caused by the vibrating electric field to the regulating member, etc.

SUMMARY OF THE INVENTION

The present invention is accomplished in view of the above-mentioned circumstance, and aims to provide a developing apparatus that can reduce the variation in image density at the deformed portion of the developer carrying member without causing the adverse effects, such as the increase in size of the apparatus, and noise caused by the vibrating electric field to the regulating member.

The developing apparatus according to the present invention includes:

a developer carrying member rotatably provided for carrying a developer;

a regulating member that has conductivity, and is provided to be capable of being in contact with the developer carrying member for regulating a amount of the developer carried by the developer carrying member;

a power supply that applies voltage to the regulating member;

a deformation detecting unit that detects information relating to the deformation of the developer carrying member; and a control unit that controls the power supply to apply a correction voltage when a deformed portion of the developer carrying member passes through the regulating member in order that the amount of the developer carried by the developer carrying member in the circumferential direction is in uniform based on a result of the detection by the deformation detecting unit.

DESCRIPTION OF THE EMBODIMENTS

Embodiments of the present invention will illustratively be described below with reference to the drawings. It is to be noted that size, material, and shape of the components described in the embodiment and the relative arrangement of these components should appropriately be modified according to the structure of the apparatus to which the invention is applied or various conditions, and it is not construed that the scope of the present invention is limited to the embodiments described below.

First Embodiment

[Overall Structure of Image Forming Apparatus]

An image forming apparatus according to the first embodiment of the present invention will be described below. In the present embodiment, a dry one-component electrophotographic image forming apparatus employing a contact developing system is used as the image forming apparatus.

Figure 1:
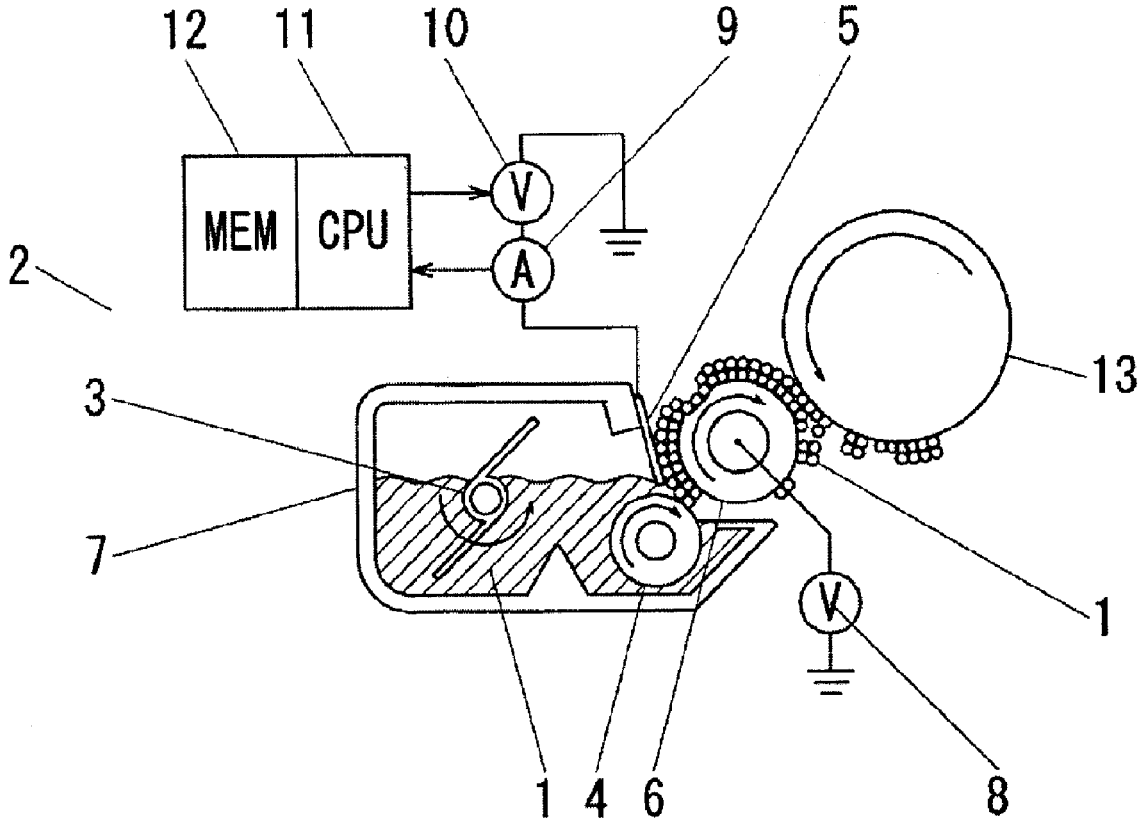
FIG. 1 is a view illustrating a schematic structure of a developing apparatus according to a first embodiment.
Figure 2:
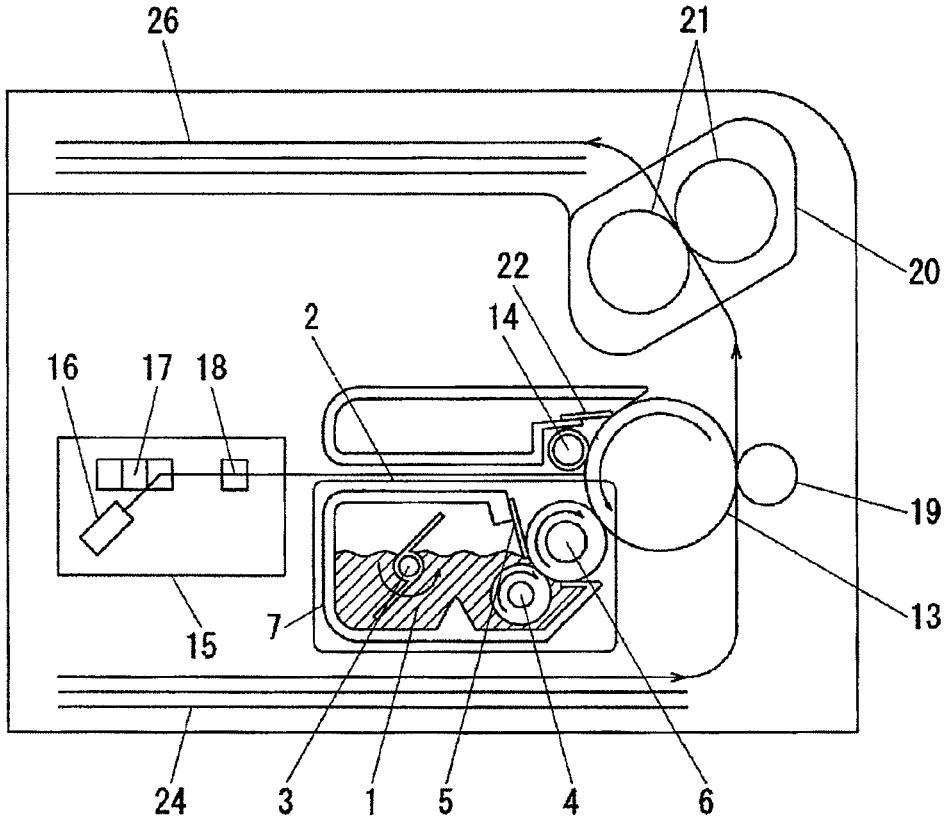
FIG. 2 is a view illustrating a schematic structure of an image forming apparatus according to the first embodiment.

FIG. 1 is a sectional view illustrating a schematic structure of the developing apparatus in the first embodiment. FIG. 2 is a sectional view illustrating the schematic structure of the image forming apparatus in the first embodiment.

The overall structure of the image forming apparatus will be described with reference to FIG. 2.

As shown in FIG. 2, there are a charging roller 14, a laser scanner 15, a toner carrying member 6 serving as a rotatable developer carrying member, a transfer roller 19, and a cleaning member 22, arranged around an image bearing member 13. A conveying path of a recording material is formed so as to pass between the image bearing member 13 and the transfer roller 19 (nip portion). A fixing unit 20 is arranged such that the recording material passes through the fixing unit 20 after it passes between the image bearing member 13 and the transfer roller 19.

The image bearing member 13 has a hole inhibiting layer and a charge generating layer applied on the surface of an aluminum cylinder with a diameter of 30 mm, and a charge transporting layer with 20 μm formed thereon. The aluminum cylinder is grounded. The image bearing member 13 is rotated with 150 mm/sec. The charging roller 14 is made of a conductive elastic member and voltage of −1100 V is applied to a metal shaft of the charging roller. When the image bearing member 13 is rotated with the charging roller 14 being brought into contact therewith, the image bearing member 13 is charged by the discharge between the charging roller 14 and the image bearing member 13. When the surface potential of the image bearing member 13 is measured by means of a surface electrometer Model 344 manufactured by Trek Inc., it is approximately −500 V.

A laser beam that is emitted from a laser scanner 15, which includes a laser 16, a polygon mirror 17, and a lens 18, is irradiated to the charged image bearing member 13. The laser beam emitted from the laser 16 scans the surface of the image bearing member 13 by the rotating polygon mirror 17 as being in synchronism with the rotation of the image bearing member 13. In this case, the light quantity of the laser beam is controlled based on the image data, whereby an electrostatic latent image is formed on the image bearing member 13. The surface potential of the portion where the maximum light quantity is received is reduced to about −100 V.

The image bearing member 13 having the electrostatic latent image formed thereon is brought into contact with the toner carrying member 6 of the developing apparatus 2. The toner carrying member 6 has toners laminated as a charged developer. Voltage of −300 V is applied to the metal shaft of the toner carrying member 6. An electric field is formed at the portion of the electrostatic latent image, where the maximum light quantity is received, in the direction in which the toner is attracted by the image bearing member 13. On the other hand, an electric field is formed at the portion, which is not exposed by the laser beam, in the direction in which toner repels the image bearing member 13. The toner is deposited onto the exposed portion of the electrostatic latent image on the image bearing member 13 due to the electrostatic force, whereby the electrostatic latent image is developed to be a toner image.

Then, the image bearing member 13 having the toner image formed thereon is brought into contact with a recording material conveyed from a sheet feed table 24. The recording material is pressed against the image bearing member 13 from the backside by the transfer roller 19 that is made of a conductive elastic member. Voltage of +1000 V is applied to a metal shaft of the transfer roller 19. Thus, the toner image on the image bearing member 13 receives force in the direction in which the toner image is attracted by the recording material, whereby the toner image is transferred onto the recording material from the image bearing member 13.

The recording material from which the toner image is transferred passes between two pressure members 21 in the fixing unit 20 in which the upper roller is heated to 180 degrees and the lower roller is heated to about 100 degrees. The toner 1 is melted and deformed by the heat to be fixed onto the recording material. The recording material having the toner image fixed thereon is discharged onto an upper discharge table 26.

[Structure of Developing Apparatus]

Next, the structure of the developing apparatus according to the present embodiment will be described with reference to FIG. 1.

The developing apparatus 2 has a toner carrying member 6 that is made of a conductive elastic member (viscoelastic material) having a length of 230 mm and a diameter of 16 mm. The toner carrying member 6 is formed such that a conductive silicon rubber having a thickness of 4 mm is formed around a metal shaft having a diameter of 8 mm, and a resin obtained by dispersing carbon and resin particles is applied onto the surface.

By virtue of this structure, the resistance of the toner carrying member 6 is about 1 MΩ, the surface roughness Ra (JIS B 0601-1994) is about 2 μm, and the hardness is about 45 degrees. A power supply 8 for the toner carrying member is connected to the metal shaft of the toner carrying member 6, so that voltage of −300 V is applied to the toner carrying member 6.

The resistance of the toner carrying member 6 is measured as described below.

A metal bar whose metal shaft has a diameter of 30 mm and whose length is longer than the toner carrying member 6 is brought into contact with the toner carrying member 6 with an intrusion amount of 30 μm. The metal bar is rotated with a surface speed of 100 mm/sec, and the toner carrying member 6 is caused to follow the metal bar. The electric current flowing when voltage of 100 V is applied between the metal shaft of the metal bar and the metal shaft of the toner carrying member 6 is measured. The value obtained by dividing the voltage of 100 V by the measured current is defined as the resistance of the toner carrying member 6.

The surface roughness is measured by means of a surface roughness measuring instrument SE-30H manufactured by Kosaka Laboratory Ltd. The hardness of the toner carrying member 6 is measured by means of ASKER durometer C type, manufactured by Kobunshi Keiki Co., Ltd., with a weight of 1 kgf (9.8 N).

A supplying roller 4 made of a urethane foam member and having a diameter of 14 mm and a plate-like regulating member 5 made of a stainless 316 and having a length of 12 mm are in contact with the toner carrying member 6.

The foam member of the supplying roller 4 is an open-cell. The number of cells that the line of 1 inch on the surface crosses is about 80, and the hardness is about 15 degrees. The hardness of the supplying roller 4 is measured by means of ASKER durometer CSC2 type, manufactured by Kobunshi Keiki Co., Ltd.

An amperemeter 9 serving as deformation detecting means (deformation detecting unit) and a regulating-member power supply 10 serving as voltage applying means (power supply) for applying voltage to the regulating member 5 are connected to the regulating member 5. The amperemeter 9 measures electric current flowing through the regulating member 5 as information relating to the deformation of the toner carrying member 6.

The amperemeter 9 and the regulating-member power supply 10 are connected to an operation unit 11 having a storage device (storage unit) 12 serving as storage means. The operation unit (control unit) 11 forms control means and deriving means. The operation unit 11 reads the measured value of the amperemeter 9 so as to set the output potential of the regulating-member power supply 10. The output of the amperemeter 9 is defined such that the direction in which the current flows into the regulating member 5 is specified as positive.

The toner 1 is a non-magnetic toner manufactured by a suspension polymerization. The average particle diameter of the toner 1 is about 6.5 μm. In order to modify the surface property, particle of silicon oxide of 20 nm is uniformly deposited onto the surface in an amount of 1.5% in a toner weight. The toner of 100 g is filled in a developer container 7. The average particle diameter of the toner is a volume-average particle diameter measured by a laser diffraction particle size analyzer LS-230 manufactured by Beckman Coulter, Inc.

The toner 1 put into the developer container 7 is fed to the vicinity of the supplying roller 4 by a stirring member 3. The supplying roller 4 and the toner carrying member 6 rotate in the clockwise direction in FIG. 1, and are in contact with each other by an intrusion amount of 1 mm. The supplying roller 4 presses the toner against the toner carrying member 6 so as to deposit the toner. The deposited toner enters the contact portion between the regulating member 5 and the toner carrying member 6.

When the toner carrying member 6 does not have the deformation, DC voltage of −400 V is applied to the regulating member 5. The contact width of the regulating member 5 and the toner carrying member 6 is about 1.4 mm, and the free end of the regulating member 5 is in contact with the end of the contact portion. The contact force per unit length between the regulating member 5 and the toner carrying member 6 is 20 N/m. The regulating member 5 regulates the toner on the toner carrying member, i.e., the amount (thickness) of the toner carried and fed by the toner carrying member 6. The toner amount per unit area is about 0.4 mg/cm$^2$, and the toner charging amount per unit mass is about −30 μC/g.

The toner charging amount per unit mass and the toner amount per unit area are obtained as described below. Specifically, the toner on the toner carrying member is collected by suction with a suction-type Faraday gauge having a filter therein. The toner charging amount per unit mass and the toner amount per unit area are obtained from the charge measured by the Faraday gauge, the collected area of the toner, and the mass increase of the filter. In other words, the toner charging amount per unit mass is obtained by dividing the charge measured by Faraday gauge by the mass increase of the filter, while the toner amount per unit area is obtained by dividing the mass increase of the filter by the collected area.

The contact force between the regulating member 5 and the toner carrying member 6 is measured as follows. A stainless plate having a width of 30 mm and a thickness of 30 μm is bent and a stainless having a width of 15 mm and a thickness of 30 μm is inserted therein. The resultant is inserted between the regulating member 5 and a first toner carrying member 6. The force exerted when the stainless plate inserted therebetween is pulled out is measured by a digital force gauge DS2 manufactured by IMADA Co., Ltd. The value obtained by dividing this force by the width of the stainless plate is defined as a contact force per unit length.

The toner carrying member 6 rotates in the clockwise direction with the surface speed of 200 mm/sec in FIG. 1. It is brought into contact with the image bearing member 13, which rotates in the counterclockwise direction in FIG. 1, with an intrusion amount of 30 μm. In this case, the contact width is about 2 mm.

[Mechanism for Correcting Toner Amount at Deformed Portion of Toner Carrying Member]

An operation of correcting an amount of toner on the deformed portion (deformed region) of the toner carrying member 6 will be described in the developing apparatus that is configured and driven as described above.

Figure 3:
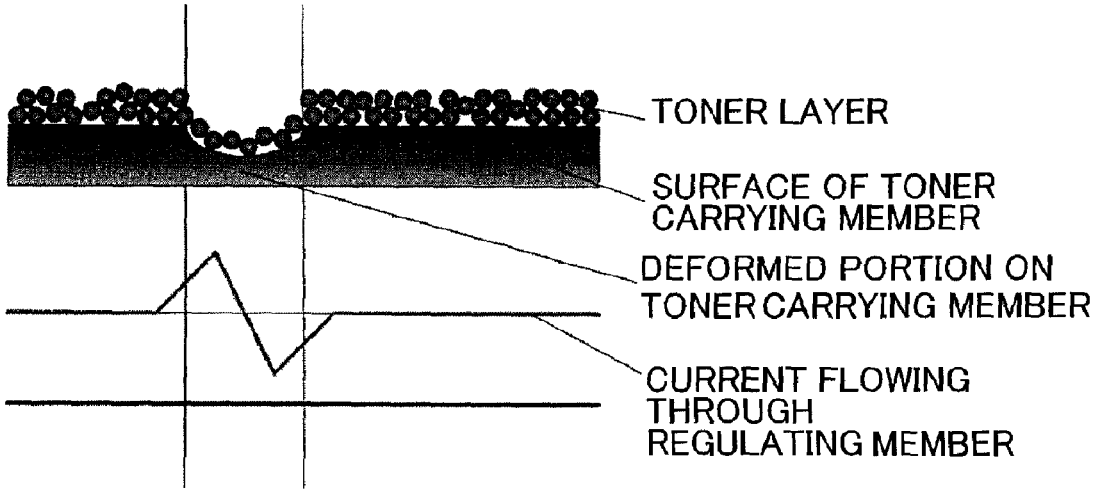
FIG. 3 is an explanatory view of a detection of deformation of a toner carrying member in the first embodiment.

FIG. 3 is a view for explaining the detection of deformation of the toner carrying member 6 in the present embodiment.

Before the image formation is started (before the image forming operation), the developing apparatus is driven, as a preceding process, with the condition the same as that in the image formation. In this case, the current flowing through the regulating member 5 is measured by the amperemeter 9 in a period more than one revolution period of the regulating member 5. The measured data is taken into the operation unit. The current waveform taken into the operation unit is subject to low-pass filter process with 100 Hz in the operation unit in order to reduce noise. Instead of the low-pass filter process, there is means that cumulates the measurement per revolution period of the regulating member 5 so as to reduce noise.

In this case, the waveform illustrated in FIG. 3 is obtained as the current waveform. A vibration appears at the portion in the current waveform corresponding to the deformed portion of the toner carrying member 6. The operation unit 11 detects the amplitude and the position of the vibration.

Next, a correction waveform is determined by the operation unit 11 from the relationship between the current waveform, which is stored beforehand in the storage device, and a correction voltage, which should be applied to the regulating member 5 in order that the amount of the toner on the toner carrying member 6 in the circumferential direction is in uniform, and the resultant waveform is generated. Then, the correction waveform is synchronized with the vibration in the current waveform measured by the amperemeter during the image forming operation, and then, is outputted from the regulating-member power supply 10 as superimposed on the DC voltage of the regulating member 5.

[Detection Mechanism of Deformed Portion on Toner Carrying Member]

A mechanism for detecting the deformed portion on the toner carrying member 6 by the configuration of the developing apparatus described above will be described next.

Figure 5:
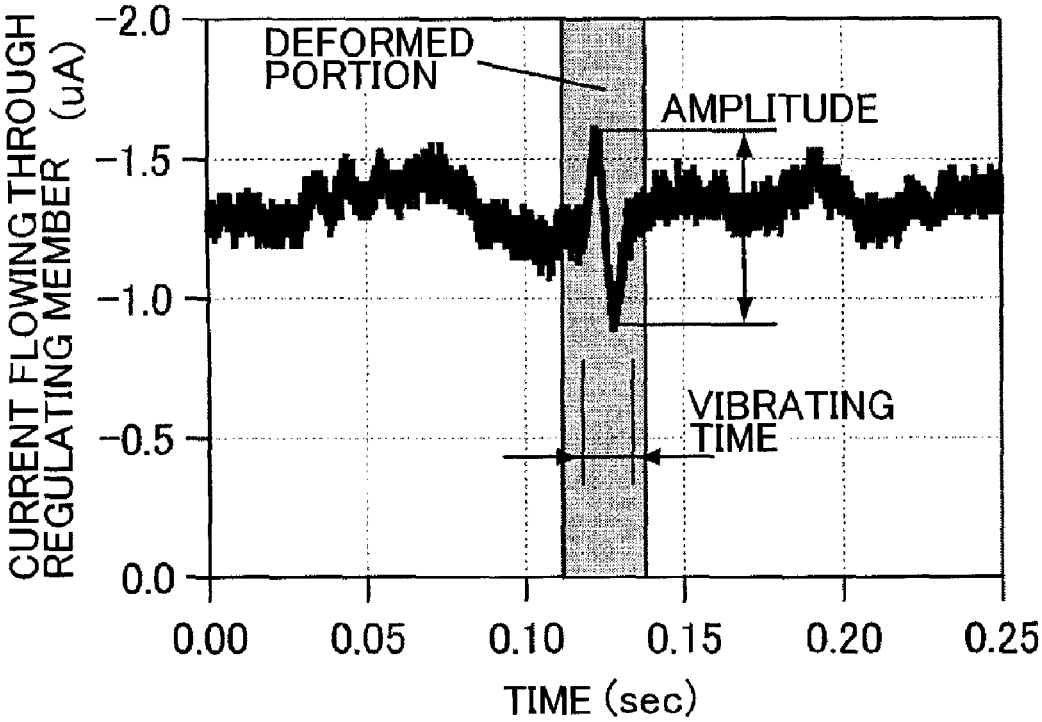
FIG. 5 is a graph illustrating electric current flowing through the regulating member in the first embodiment.

FIG. 5 is a view illustrating the current flowing through the regulating member 5 in the present embodiment.

When the deformed portion on the toner carrying member 6 passes through the contact portion between the conductive regulating member 5 and the toner carrying member 6, the toner amount is varied on the deformed portion as shown in FIG. 3, and the current flows through the regulating member 5. This current includes the current generated since the toner passes between the regulating member 5 and the toner carrying member 6 as being charged, and induction current generated since the regulating member 5 moves due to the deformation on the toner carrying member 6 so as to change the electrostatic capacitance of the regulating member 5 and the toner carrying member 6.

Since the regulating member 5 moves vertically due to the deformation on the toner carrying member 6, the induction current assumes a vibrating waveform illustrated in FIG. 5. The vibrating time is substantially equal to the time when the deformation on the toner carrying member 6 passes through the regulating member 5. Thus, the deformed portion on the toner carrying member 6 can be detected by measuring the current flowing through the regulating member 5.

Since the current flowing through the regulating member 5 arises from the vertical motion of the regulating member 5 caused by the deformation on the toner carrying member 6, it has a correlation with the change in the toner amount caused by the deformation on the toner carrying member 6. The amplitude of the correction waveform necessary for the correction can be estimated from the amplitude of the vibrating waveform of the current flowing through the regulating member 5, and the application time of the correction waveform necessary for the correction can be estimated from the vibrating time.

[Mechanism of Correcting Variation in Toner Amount]

A mechanism of correcting the variation in the toner amount by the developing apparatus described above will be described next.

When a potential difference having the same polarity as that of the toner is given to the conductive regulating member 5 with respect to the toner carrying member 6, the amount of the toner on the toner carrying member increases. When the potential difference having the reverse polarity to that of the toner is given to the regulating member 5, the amount of the toner on the toner carrying member decreases.

As described above, the amount of the toner on the toner carrying member can be changed by giving the potential difference to the regulating member 5 with respect to the toner carrying member 6. The regulating-member power supply 10 applies the correction voltage, corresponding to the deformation on the toner carrying member 6, to the regulating member 5 at the timing when the deformed portion of the toner carrying member 6 passes through the contact portion between the regulating member 5 and the toner carrying member 6 (when the regulating member 5 is brought into contact with the deformed portion on the toner carrying member 6) during the image forming operation.

When the deformed portion of the toner carrying member 6 passes through the contact portion between the regulating member 5 and the toner carrying member 6, the correction voltage corresponding to the deformation of the toner carrying member 6 is applied, whereby the variation in the amount of the toner on the toner carrying member can be reduced.

When a rectangular wave is employed as the correction voltage, the potential of the toner carrying member 6 might be varied at the rising edge and the falling edge of the rectangular wave. In this case, the potential difference between the toner carrying member 6 and the image bearing member 13 varies, so that the amount of the toner developed on the image bearing member 13 might vary. Therefore, a waveform having a trapezoidal shape as shown in FIG. 4, such as a trapezoidal wave, which does not rapidly change like the rectangular wave, may be employed as the correction voltage.

[Example of Detecting Deformed Portion on Toner Carrying Member and Correcting Variation in Toner Amount]

Figure 4:
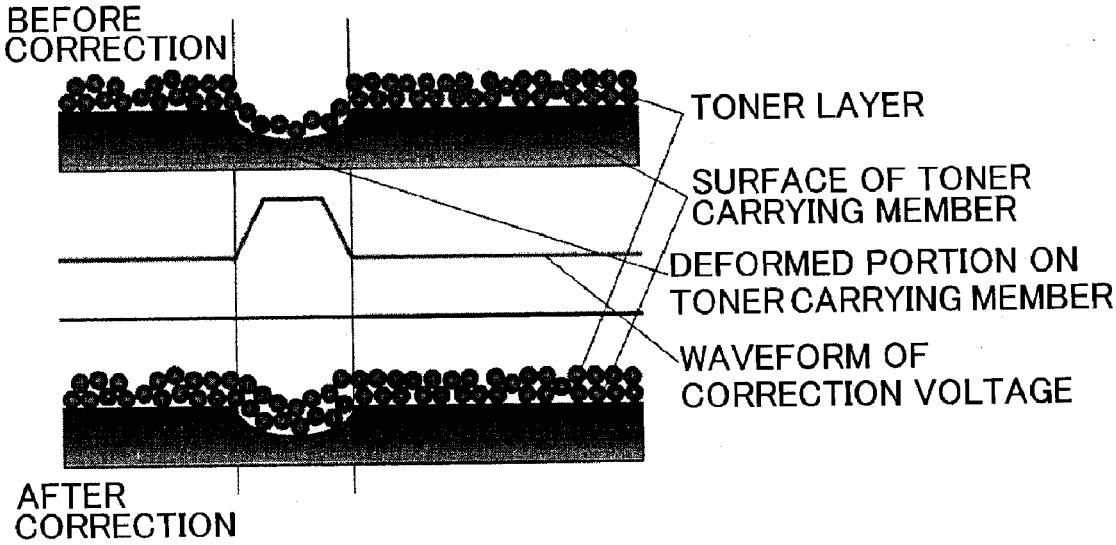
FIG. 4 is a view for explaining a correction of a toner amount in the first embodiment.
Figure 6:
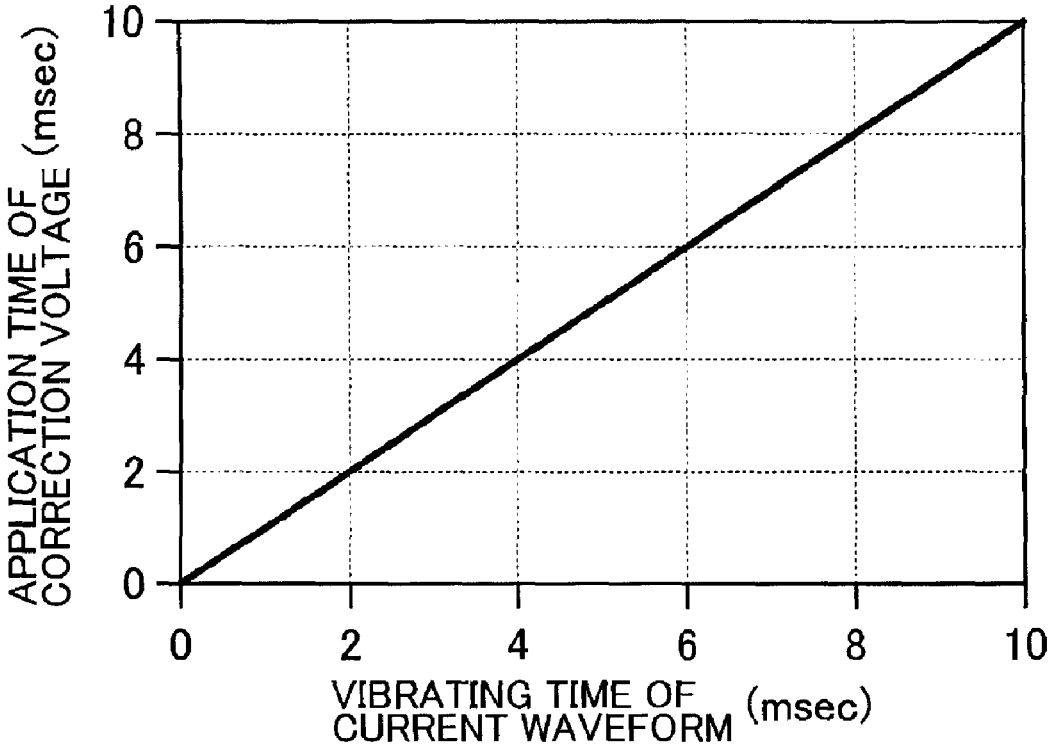
FIG. 6 is a graph illustrating the relationship between the amplitude time of the waveform of the current and the application time of the correction voltage in the first embodiment.
Figure 7:
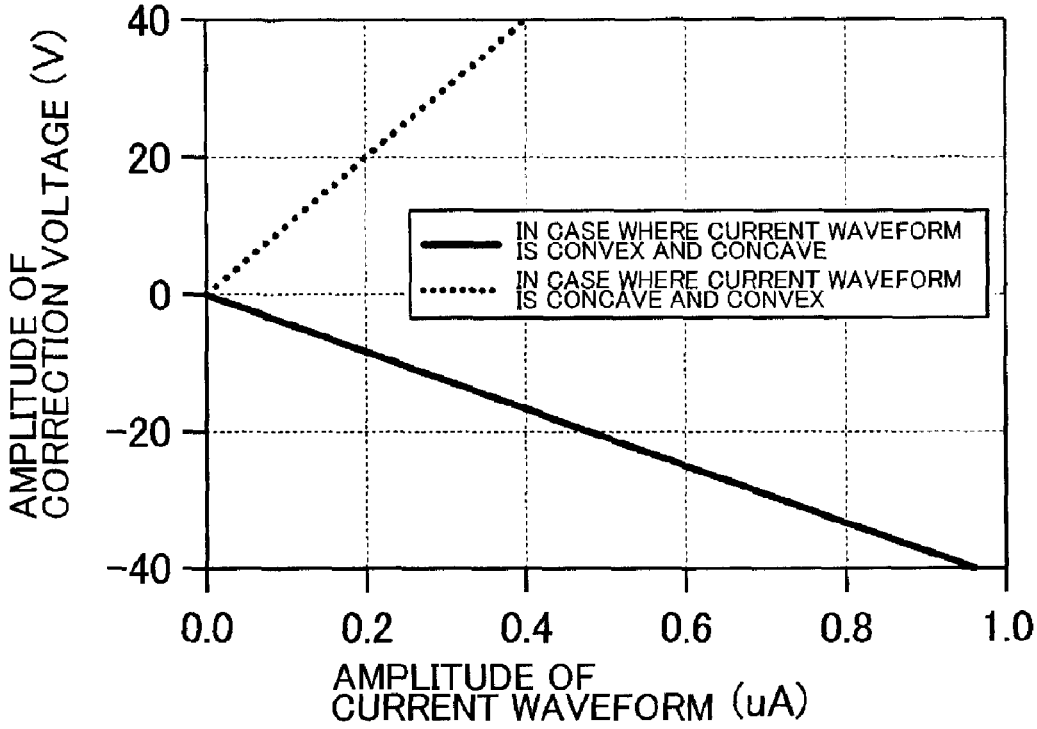
FIG. 7 is a graph illustrating the relationship between the amplitude of the current waveform and the amplitude of the correction voltage in the first embodiment.
Figure 8:
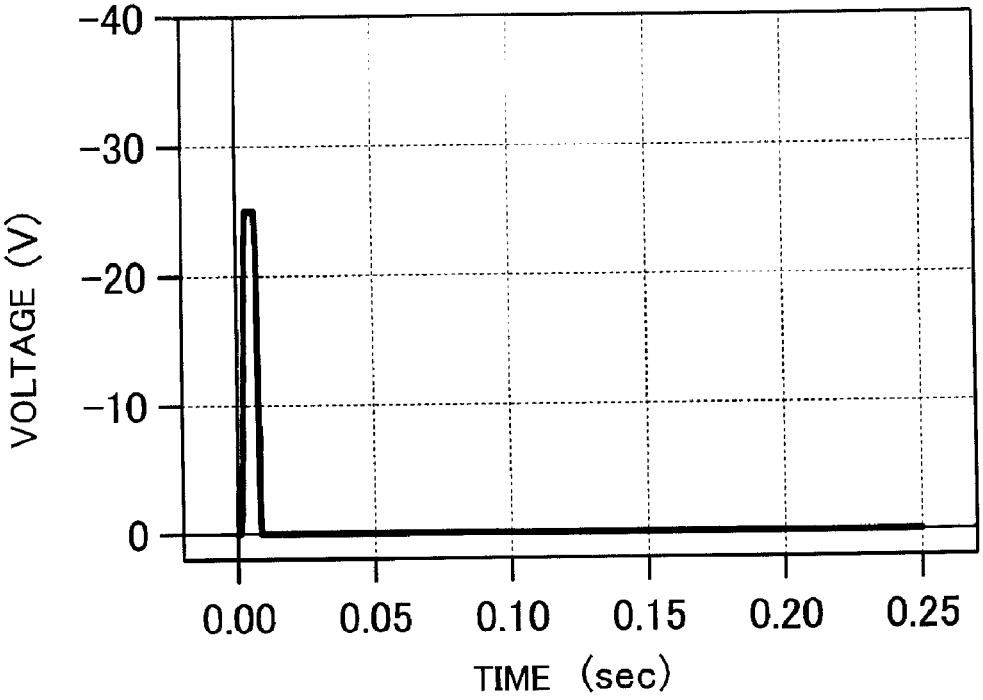
FIG. 8 is a view illustrating the correction voltage applied to the regulating member in the first embodiment.
Figure 9:
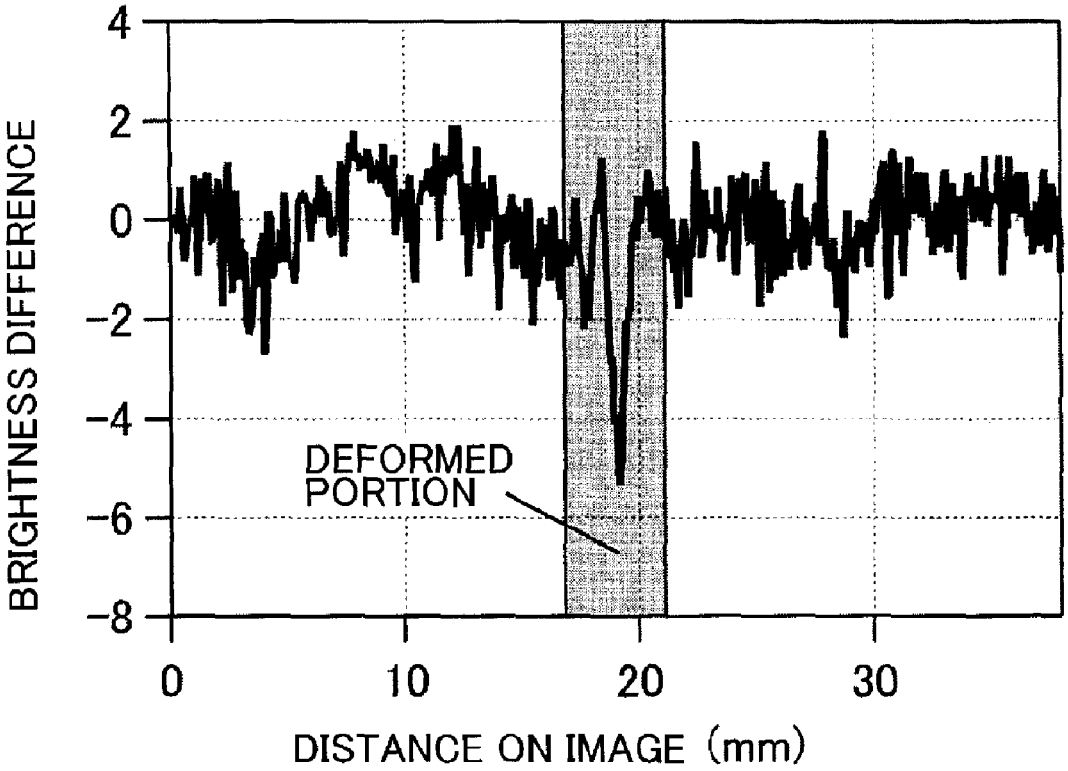
FIG. 9 is a graph illustrating the variation in the density of the image that is not corrected.
Figure 10:
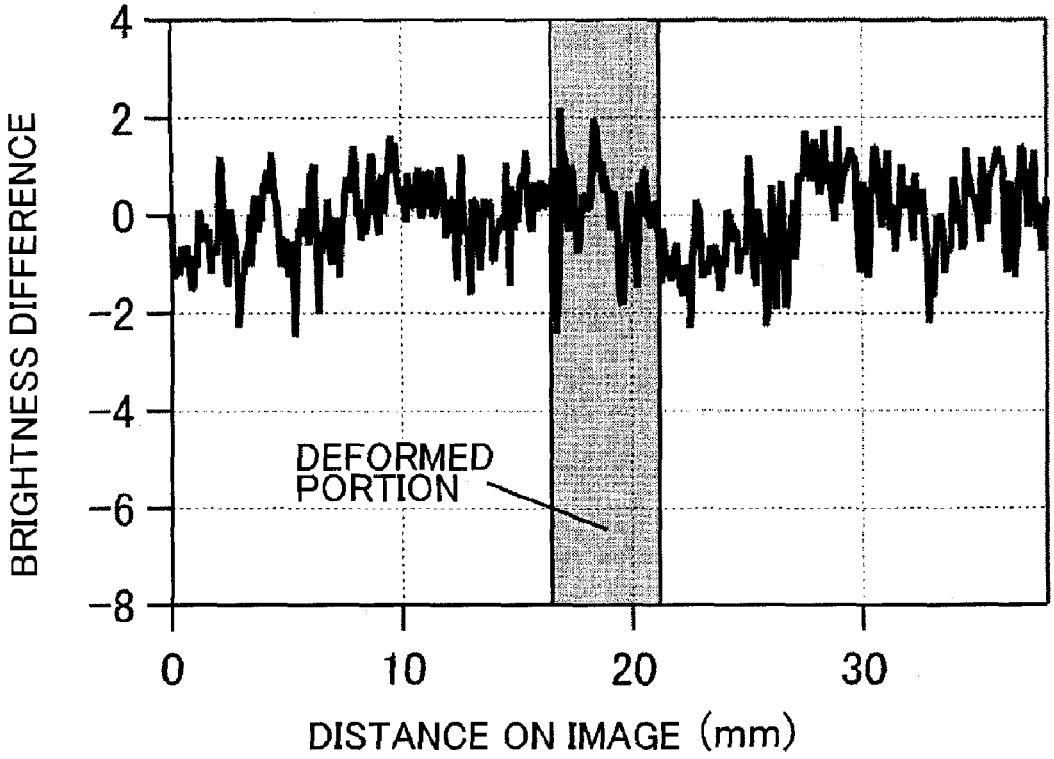
FIG. 10 is a graph illustrating the variation in the density of the corrected image in the first embodiment.
Figure 11:
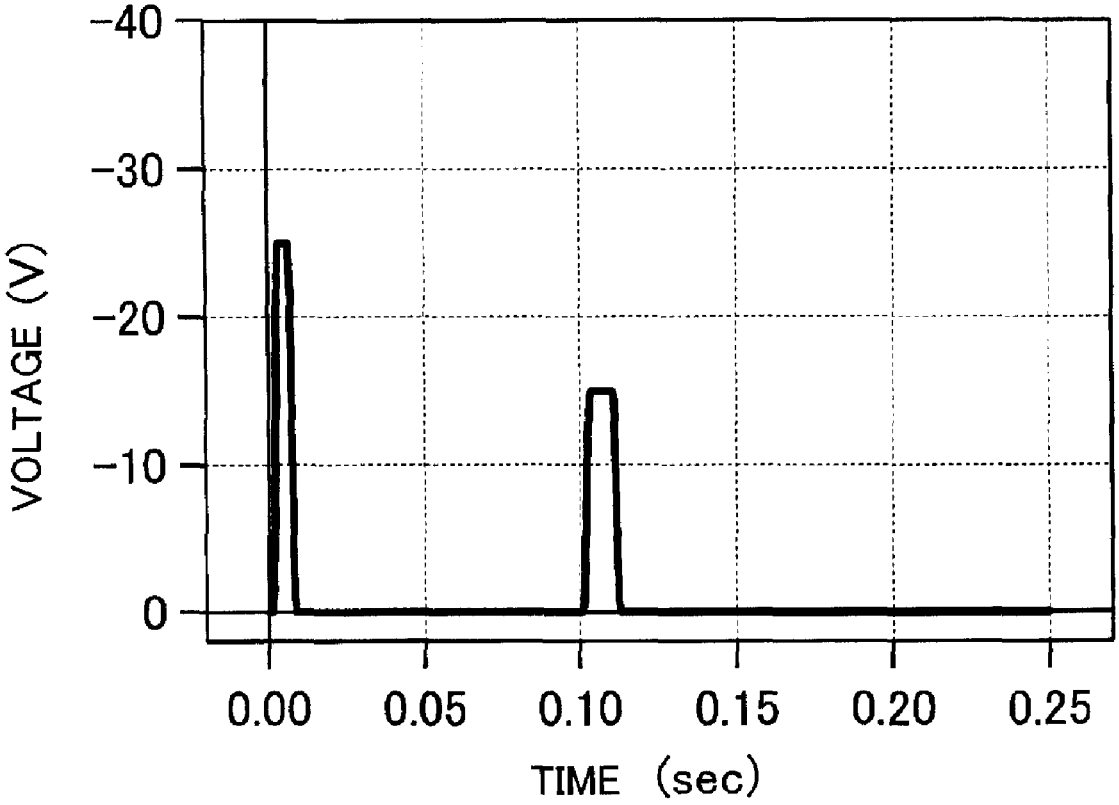
FIG. 11 is a graph illustrating the correction voltage in a case where the toner carrying a member has two deformed portions in the first embodiment.

FIG. 4 is a view for explaining the correction of the toner amount in the present embodiment. FIG. 6 is a graph showing the relationship between the vibrating time of the current waveform and the application time of the correction voltage in the present embodiment. FIG. 7 is a graph showing the relationship between the amplitude of the current waveform and the amplitude of the correction voltage in the present embodiment. FIG. 8 is a view showing the correction voltage applied to the regulating member 5. FIG. 9 is a view showing the density variation of an image that is not corrected. FIG. 10 is a view showing the density variation of the corrected image in the present embodiment. FIG. 11 is a view showing the correction voltage when the toner carrying member 6 has two deformed portions in the present embodiment.

The developing apparatus thus configured was stopped for one month under the environment of temperature of 40° C. and humidity of 80%, and then, an image was outputted without detecting the deformed portion and without correcting the variation in the toner amount according to the present embodiment. As a result, the density variation shown in FIG. 9 appears due to the deformation on the toner carrying member 6. The maximum density variation was about 5. The deformation of the toner carrying member 6 is a permanent deformation due to the compression, which is caused by the application of pressure to the toner carrying member 6 by the regulating member 5 for a long period of time.

The density variation is obtained in such a manner that the outputted image is taken by a scanner LiDE 40 manufactured by Canon Inc. with the resolution of 300 dpi and monochrome 256-gray levels, and the average value of the portion where the density variation is not generated is subtracted from the brightness.

The case in which the deformed portion is detected and the variation in the toner amount is corrected according to the present embodiment will be described next.

When the developing apparatus is driven, the current waveform shown in FIG. 5 is measured by the amperemeter with the rotation period (0.25 sec) of the toner carrying member 6. When the vertical vibration of the waveform is detected by the operation unit, the vibration having an irregularity shape, a peak interval of 8 msec, and full width of 0.6 μA is detected during the period from 0.12 see to 0.14 sec. As described above, the deformation on the toner carrying member can be detected before the image forming operation.

The storage device stores the relationship (FIG. 6) between the vibrating time of the vibrating waveform of the current flowing through the regulating member 5 and the application time of the correction voltage, and the relationship (FIG. 7) between the amplitude of the vibrating waveform of the current and the amplitude of the correction voltage, which are experimentally obtained beforehand. From these relationships and the result of the detection, a trapezoidal wave (FIG. 8) whose application time is 8 msec and whose amplitude is −25 V is generated by the operation unit. The rate of change of the potential of the trapezoidal wave is limited to be not more than 25 V/sec in order to suppress the potential variation of the toner carrying member 6.

The correction waveform is applied to the regulating-member power source 10 during the image forming operation as superimposed on the DC voltage for every rotation period of the toner carrying member 6 in synchronism with the vibrating portion in the current waveform measured by the amperemeter.

FIG. 10 shows the density variation in the outputted image when the deformed portion is detected, and the variation in the toner amount is corrected as described above according to the present embodiment. The maximum density variation of the deformed portion on the toner carrying member 6 is 2, which means that the density variation of the deformed portion falls within the range of the density variation on the other portion. Accordingly, the density variation due to the deformation of the toner carrying member 6 is reduced, so that the amount of the toner carried by the toner carrying member 6 is in uniform (equalized).

As described above, according to the present embodiment, the variation (non-uniformity) in the image density at the deformed portion on the toner carrying member 6 can be reduced without increasing the size of the developing apparatus due to the addition of a driving mechanism of the regulating member 5 and without causing an adverse effect such as noise caused by the application of the vibrating electric field to the regulating member 5.

In the present embodiment, the deformation on the toner carrying member 6 is generated only at the contact portion between the regulating member 5 and the toner carrying member 6. However, the deformation on the toner carrying member 6 may be generated at the contact portion between the image bearing member 13 and the toner carrying member 6. When the toner carrying member 6 has two or more deformed portions, the respective deformed portions are detected, and a correction voltage having two or more correction waveforms superimposed as shown in FIG. 11 is applied, whereby the density variation can be reduced.

The relationship between the vibrating time of the vibrating waveform of the current flowing through the regulating member 5 and the application time of the correction voltage, and the relationship between the amplitude of the vibrating waveform of the current and the amplitude of the correction voltage are acquired as described below.

Several types of toner carrying members, each having deformation whose degree is different, are mounted to an image forming apparatus. When a developing apparatus is driven, current flowing through the regulating member 5 is measured. An image is outputted as the amplitude and the application time of the correction waveform are changed. The variations in the density of the outputted images are measured, and amplitude and the application time of the correction waveform by which the density variation becomes the minimum are associated with the amplitude and vibrating time of the waveform of the current flowing through the regulating member 5.

In the present embodiment, the dry one-component electrophotographic image forming apparatus employing a contact developing system is used as the image forming apparatus. However, the present invention is not limited thereto. The present invention is preferably applicable to an image forming apparatus in which a toner carrying member is deformed because a regulating member or an image bearing member is brought into contact with the toner carrying member, and the variation in an image density at the deformed portion on the toner carrying member is feared.

Second Embodiment

A second embodiment according to the present invention will be described below. The components different from those in the first embodiment will be described, and the components same as those in the first embodiment will not be repeated.

Figure 12:
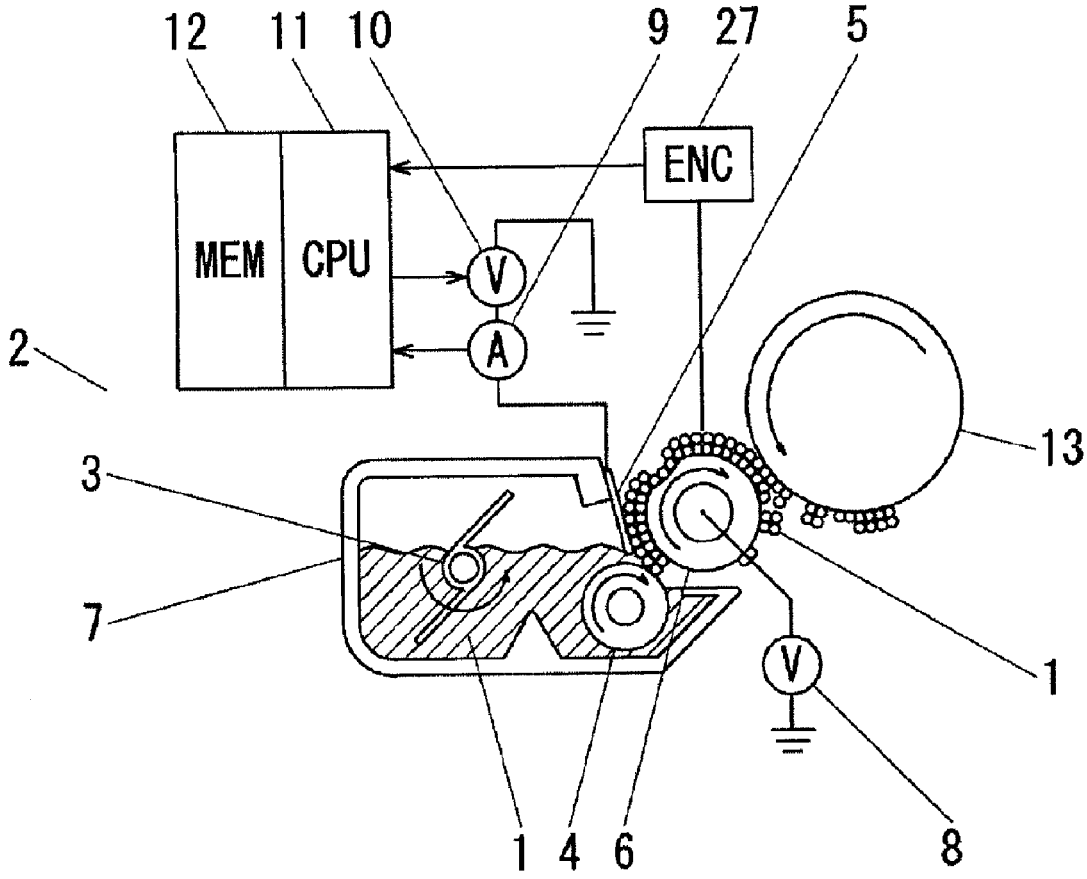
FIG. 12 is a view illustrating a schematic structure of a developing apparatus according to a second embodiment.
Figure 13:
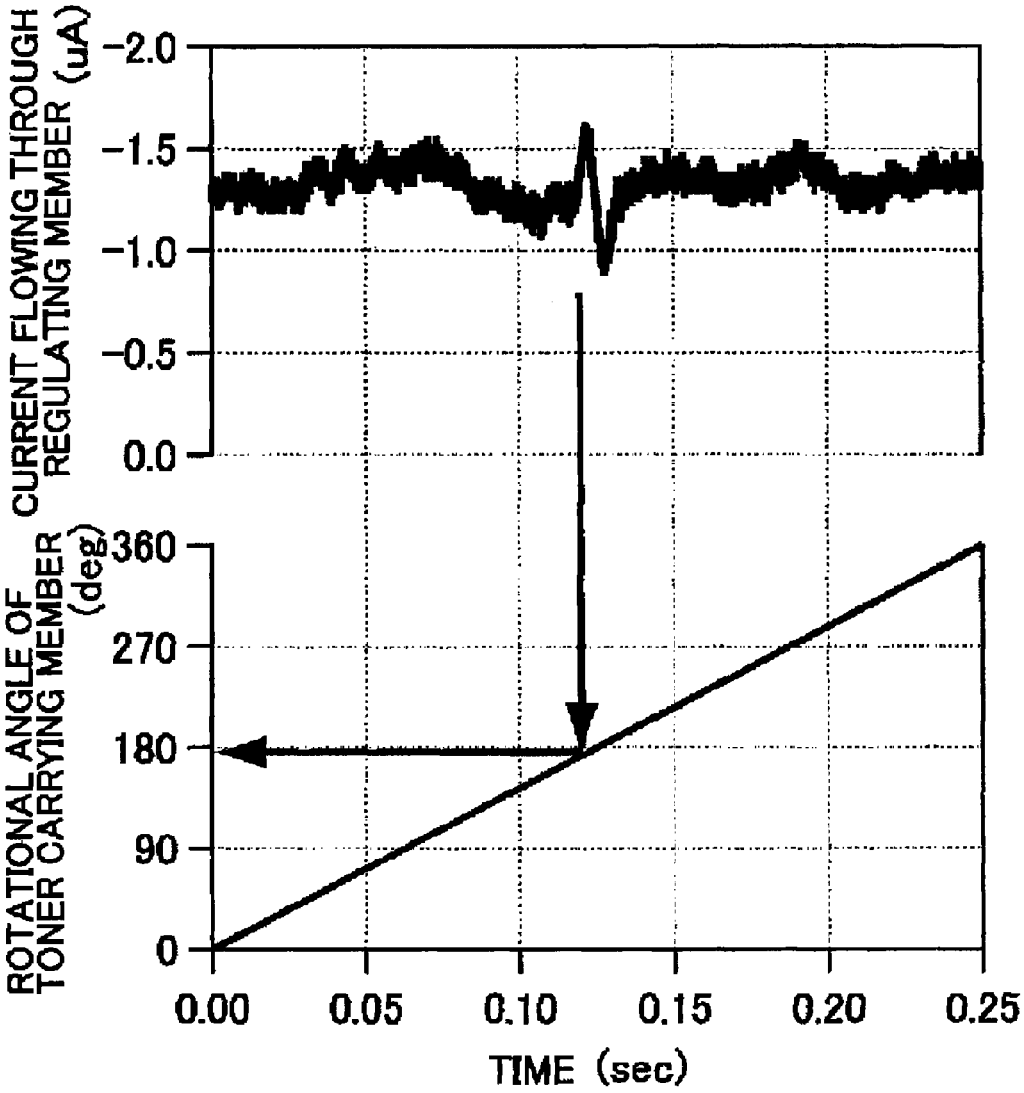
FIG. 13 is a graph illustrating the relationship between the current of the regulating member and the rotational angle of the toner carrying member in the second embodiment.

FIG. 12 is a view showing a schematic structure of a developing apparatus in the present embodiment. FIG. 13 is a graph showing the relationship between the current flowing through the regulating member 5 and the rotational angle of the toner carrying member 6 in the present embodiment.

As shown in FIG. 12, a phase measuring device 27, serving as phase detecting means (phase detecting unit), that measures the rotational phase of the toner carrying member 6 is provided with the developing apparatus 2 in addition to the structure shown in the first embodiment. The phase measuring device 27 is connected to the operation unit 11. In the present embodiment, a rotary encoder that outputs a rotational angle of the toner carrying member 6 is employed as the phase measuring device 27.

In the present embodiment, when the developing apparatus is driven before the image forming operation, the current flowing through the regulating member 5 is measured, and further, the rotational angle of the toner carrying member 6 is measured. The operation unit measures the rotational angle of the toner carrying member 6 when the deformation on the toner carrying member 6 is detected as shown in FIG. 13, and the measured value is stored in the storage device.

The correction voltage is applied to the regulating-member power supply as superimposed on the DC voltage, for every rotational cycle of the toner carrying member 6, in synchronism with the timing when the output from the phase measuring device 27 becomes the stored rotational angle of the toner carrying member 6.

Thus, the density variation can be corrected even when the developing apparatus is stopped after the detection of the deformation on the toner carrying member 6 or when the driving speed of the developing apparatus is changed.

Third Embodiment

A third embodiment according to the present invention will be described below. The components different from those in the embodiments 1 and 2 will be described, and the components same as those in the embodiments 1 and 2 will not be repeated.

Figure 14:
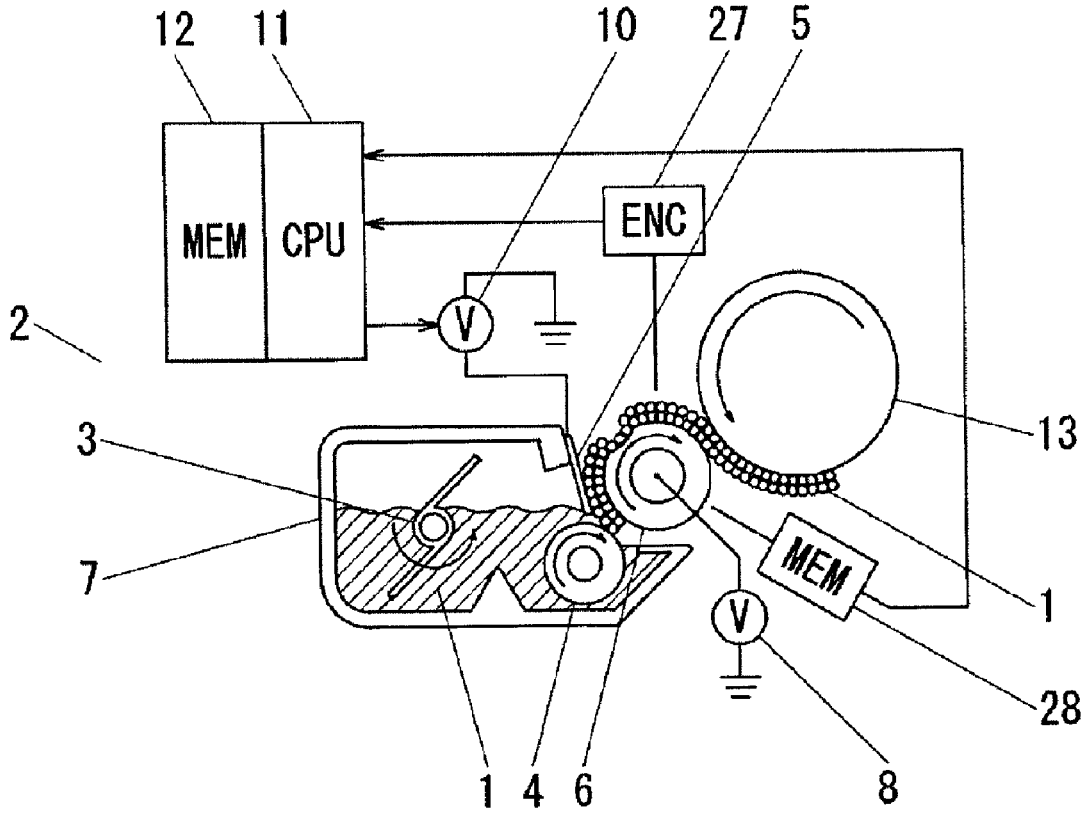
FIG. 14 is a view illustrating a schematic structure of a developing apparatus according to a third embodiment.

FIG. 14 is a view showing a schematic structure of a developing apparatus according to the present embodiment.

In the present embodiment, the amperemeter connected to the regulating member 5 is not provided to the developing apparatus in the first embodiment, but a displacement measuring device 28 serving as deformation detecting means and a phase measuring device 27 that measures the rotational angle of the toner carrying member 6 are provided to the developing apparatus in the first embodiment as shown in FIG. 14. The contact portion between the toner carrying member 6 and the image bearing member 13 is present at the position at an angle of 145 degrees in the rotating direction of the toner carrying member 6 with the contact portion between the regulating member 5 and the toner carrying member 6 defined as 0 degree. The displacement measuring device 28 is mounted such that the measured area falls within the image area at the position of 245 degrees. The output of the displacement measuring device 28 is connected to the operation unit 11. The displacement measuring device 28 measures the variation in the outer diameter (displacement on the surface (surface portion, surface part)) of the toner carrying member 6 as the information relating to the deformation on the toner carrying member 6.

In the present embodiment, a rotary encoder that outputs the rotational angle of the toner carrying member 6 is employed as the phase measuring device 27, and a laser displacement gauge of a triangulation type is employed as the displacement measuring device 28.

[Mechanism for Correcting Amount of Toner on Deformed Portion of Toner Carrying Member]

The operation of correcting the amount of the toner on the deformed portion of the toner carrying member 6 in the thus configured developing apparatus that is driven will be described below.

Figure 15:
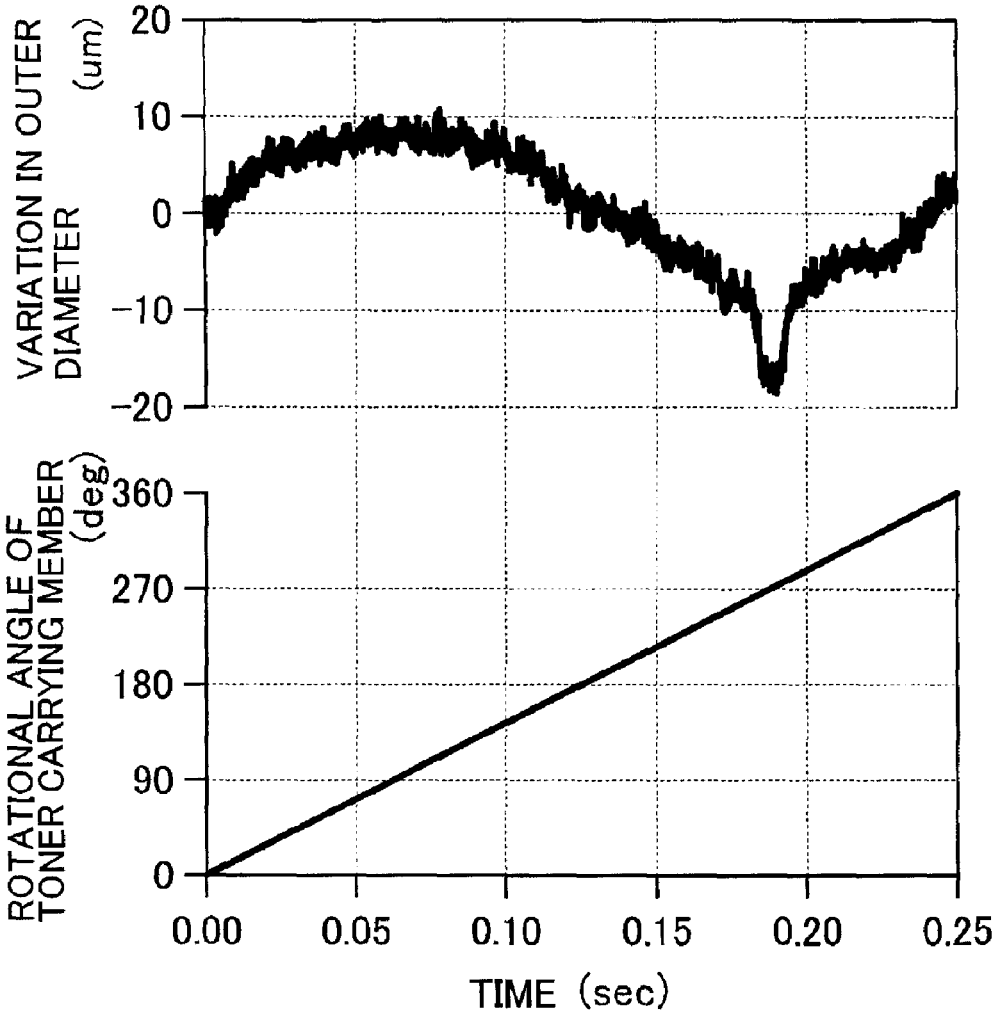
FIG. 15 is a graph illustrating the relationship between the deformation of the toner carrying member and the rotational angle in the third embodiment.
Figure 16:
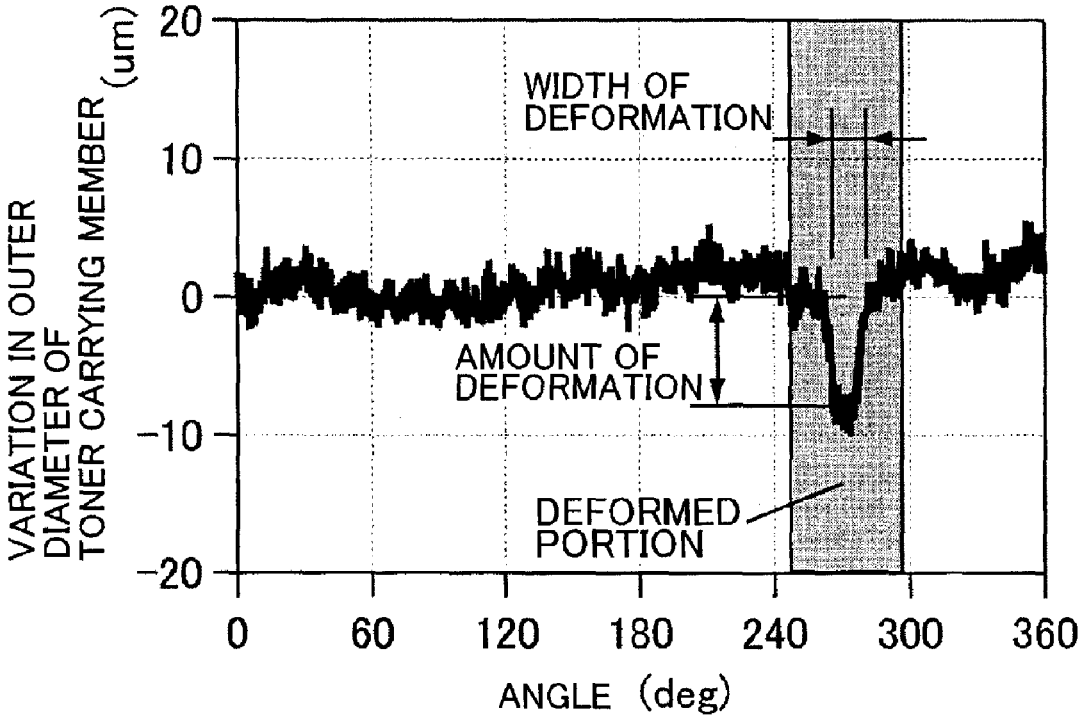
FIG. 16 is a view illustrating the variation in the outer diameter of the toner carrying member in the third embodiment.
Figure 17:
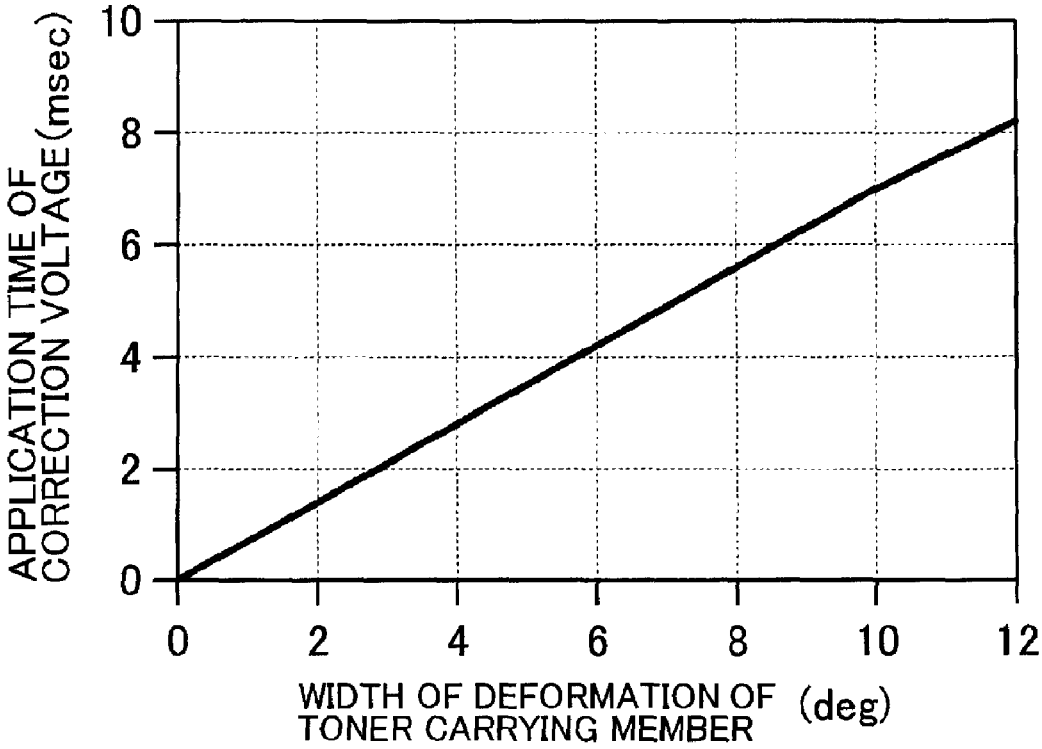
FIG. 17 is a graph illustrating the relationship between the width of the deformation of the toner carrying member and the application time of the correction voltage in the third embodiment.
Figure 18:
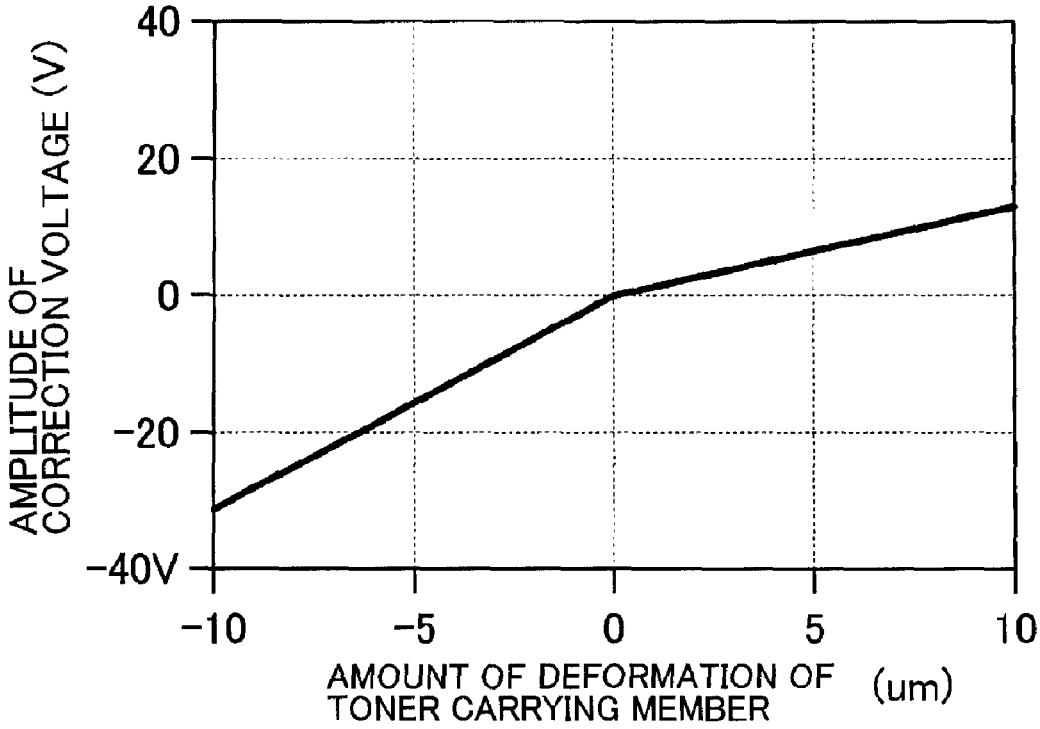
FIG. 18 is a graph illustrating the relationship between the deformed amount of the toner carrying member and the amplitude of the correction voltage in the third embodiment.
Figure 19:
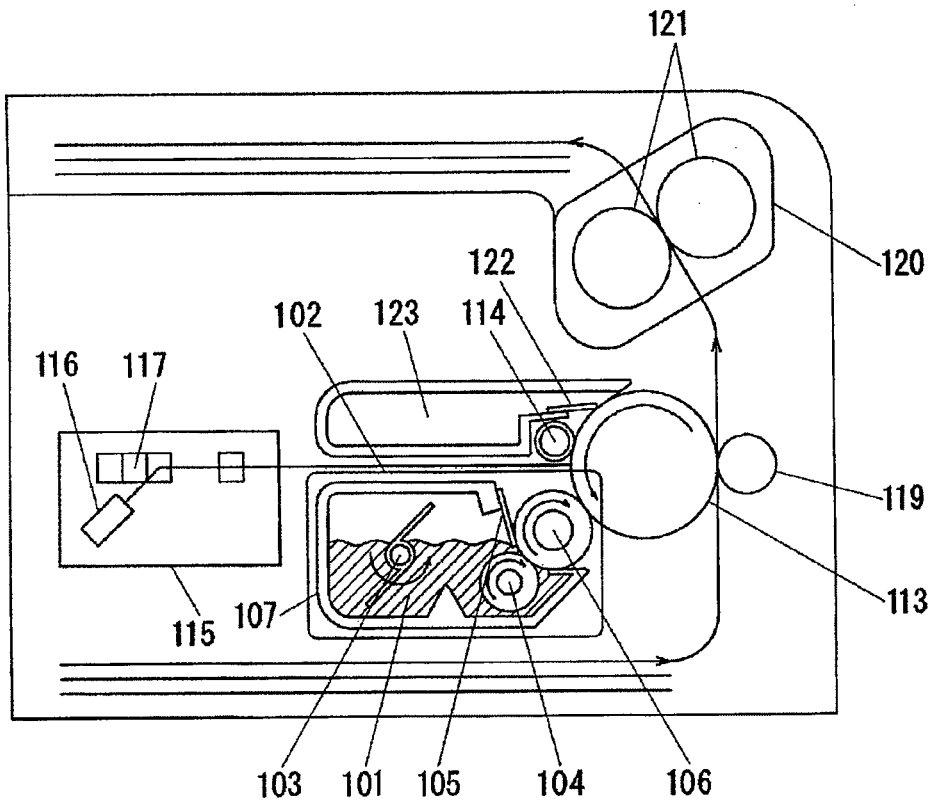
FIG. 19 PRIOR ART
FIG. 19 is a view illustrating a schematic structure of a conventional image forming apparatus.

FIG. 15 is a graph showing the relationship between the deformation and the rotational angle of the toner carrying member 6 in the present embodiment. FIG. 16 is a graph showing the variation in the outer diameter of the toner carrying member 6 in the present embodiment. FIG. 17 is a graph showing the relationship between the width of the deformation of the toner carrying member 6 in the circumferential direction and the application time of the correction voltage. FIG. 18 is a graph showing the relationship between the amount of the deformation (deformed length (depth)) of the toner carrying member 6 in the diameter direction and the amplitude of the correction voltage.

Before the image formation is started, the image bearing member 13 is fully exposed to drive the image forming apparatus as a preceding process. The exposed portion corresponds to the portion of the toner carrying member 6 measured by the displacement measuring device 28, i.e., it corresponds to one or more rotations of the toner carrying member 6.

Thus, almost all toner on the corresponding portion of the toner carrying member is developed on the image bearing member 13. The displacement measuring device 28 measures the variation in the outer diameter of the toner carrying member 6, from which almost all toner is removed after the development, during the period of one or more rotation cycles of the toner carrying member 6. Simultaneously, the rotational angle of the toner carrying member 6 is measured. The operation unit 11 receives the measurement data of the variation in the outer diameter and the angle of the toner carrying member 6. The measurement data includes the variation caused by the shift of the shaft of the toner carrying member 6. Therefore, the operation unit 11 performs a Fourier transform so as to remove the component of one rotation cycle, and then, performs an inverse Fourier transform to remove this.

The operation unit 11 detects the depth of the deformation and the rotational angle of the deformed portion from the waveform of the variation in the outer diameter of the toner carrying member 6. Then, the operation unit 11 generates a correction waveform from the relationship between the waveform of the variation in the outer diameter of the toner carrying member 6 and the correction waveform, which is stored beforehand in the storage device. Since the displacement measured position and the regulating member 5 to which the correction waveform is applied are located at the different positions, the correction waveform is synchronized with the timing showing the value obtained by adding the angular difference of 115 degrees between the contact portion of the regulating member 5 with the toner carrying member 6 and the displacement measuring position to the rotational angle where the deformation is detected. During the image forming operation, the correction waveform is outputted from the regulating-member power supply 10 as superimposed on the DC voltage of the regulating member 5.

[Example of Detecting Deformed Portion on Toner Carrying Member and Correcting Variation in Toner Amount]

The developing apparatus having the configuration according to the present embodiment is stopped under the condition of temperature of 40° C. and humidity of 80% for one month, and then, an image is outputted, like the first embodiment. On the other hand, the case in which the deformed portion is detected and the variation in toner amount is corrected according to the present embodiment will be described.

The variation in the outer diameter and the rotational angle of the toner carrying member 6, which has no toner deposited thereon after the development, measured by the displacement measuring device 28 in the preceding process is as illustrated in FIG. 15 with the rotational cycle (0.25 sec). When the operation unit 11 removes the component of one cycle of the toner carrying member, the graph shown in FIG. 16 is obtained. As a result of the detection of the deformation from the variation in the outer diameter of the toner carrying member 6, the deformation having a depth of −8 μm and width of 10 degrees is detected near 270 degrees.

The storage device stores the relationship (FIG. 17) between the width of the deformation on the toner carrying member 6 and the application time of the correction voltage, and the relationship (FIG. 18) between the amount of the deformation and the amplitude of the correction voltage, which are experimentally obtained beforehand. From these relationships and the result of the detection, a trapezoidal wave whose application time is 8 msec and whose amplitude is −25 V is generated by the operation unit 11. The rate of change of the potential of the trapezoidal wave is limited to be not more than 25 V/sec in order to suppress the potential variation of the toner carrying member 6. The correction waveform is applied to the regulating-member power supply 10 during the image forming operation as superimposed on the DC voltage for every rotation period of the toner carrying member 6 in synchronism with the timing when the phase measuring device measures 25 degrees. Thus, the density variation due to the deformation on the toner carrying member 6 is reduced.

The relationship between the width of the deformation on the toner carrying member 6 and the application time of the correction voltage, and the relationship between the amount of the deformation and the amplitude of the correction voltage are acquired as described in the same manner as in the first embodiment.

Several types of toner carrying members, respectively having different deformation degrees, are mounted to the image forming apparatus, and the deformation on each of the toner carrying members is measured by the displacement measuring device. An image is outputted as the amplitude of the correction waveform and the application time are changed. The variations in the density of the outputted images are measured, and amplitude and the application time of the correction waveform by which the density variation becomes the minimum are associated with the width and amount of the deformation on each of the toner carrying members.

In the present embodiment, the phase measuring device 27 is employed. However, the phase measuring device 27 may not be used like the first embodiment.

Although the embodiments to which the present invention is applicable have been described above, the present invention is not restricted to the above-described embodiment, but may be modified in every ways within the technical idea of the invention.

This application claims priority from Japanese Patent Application No. 2008-99556 filed Apr. 7, 2008, which hereby incorporated by reference herein.

What is claimed is:

1. A developing apparatus comprising:

a developer carrying member rotatably provided for carrying a developer;

a regulating member that has conductivity, and is provided to be capable of being in contact with the developer carrying member for regulating an amount of the developer carried by the developer carrying member;

a power supply that applies voltage to the regulating member;

a deformation detecting unit that detects information relating to a deformation of the developer carrying member; and a control unit that controls the power supply to apply a correction voltage when a deformed portion of the developer carrying member passes through the regulating member in order that the amount of the developer carried by the developer carrying member in a circumferential direction is uniform based on a result of the detection by the deformation detecting unit.

2. The developing apparatus according to claim 1, further comprising:

a storage unit that stores a relationship between the information relating to the deformation on the developer carrying member and the correction voltage, wherein the control unit determines the correction voltage from the relationship stored by the storage unit and the result of the detection by the deformation detecting unit.

3. The developing apparatus according to claim 2, wherein the deformation detecting unit is configured to detect the information relating to the deformation on the developer carrying member by detecting current flowing through the regulating member, and wherein the storage unit stores a relationship between a vibrating time of a vibrating waveform of the current flowing through the regulating member and an application time of the correction voltage, and a relationship between an amplitude of the vibrating waveform and an amplitude of the correction voltage.

4. The developing apparatus according to claim 2, wherein the deformation detecting unit is configured to detect information relating to the deformation of the developer carrying member by detecting displacement on a surface of the rotating developer carrying member, and wherein the storage unit stores a relationship between a width of the deformation of the developer carrying member in the circumferential direction and an application time of the correction voltage, and a relationship between a length of the deformation of the developer carrying member in a diameter direction and an amplitude of the correction voltage.

5. The developing apparatus according to claim 1, wherein the deformation detecting unit detects information relating to the deformation on the developer carrying member by detecting current flowing through the regulating member.

6. The developing apparatus according to claim 1, wherein the deformation detecting unit detects information relating to the deformation on the developer carrying member by detecting displacement on a surface of the developer carrying member.

7. The developing apparatus according to claim 1, further comprising:

a phase detecting unit that detects a rotational phase of the developer carrying member, wherein the storage unit stores the result of the detection by the deformation detecting unit and the result of the detection by the phase detecting unit as associated with each other, and the control unit determines a timing of applying the correction voltage based on the result of the detection by the deformation detecting unit and the result of the detection by the phase detecting unit during an image forming operation.

8. The developing apparatus according to claim 1, wherein the correction voltage has a trapezoidal waveform.

* * * * *